US007731295B2

(12) United States Patent
Lin

(10) Patent No.: US 7,731,295 B2
(45) **Date of Patent: *Jun. 8, 2010**

(54) CHAIR HAVING ADJUSTABLE WEIGHT PROPORTION ACCEPTING ELEMENTS

(76) Inventor: Peter Lin, No. 16, Lane 207, Tsu Tzu Rd., Nan Tou City, Nan Tou Hsein (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/204,852

(22) Filed: Sep. 5, 2008

(65) Prior Publication Data

US 2008/0315661 A1 Dec. 25, 2008

Related U.S. Application Data

(63) Continuation-in-part of application No. 11/564,386, filed on Nov. 29, 2006, now Pat. No. 7,434,888.

(51) Int. Cl.
*A47C 7/14* (2006.01)

(52) U.S. Cl. ..... 297/452.56; 297/452.13; 297/452.63; 297/452.64

(58) Field of Classification Search ..... 297/452.13, 297/452.56, 452.63, 452.64
See application file for complete search history.

(56) References Cited

U.S. PATENT DOCUMENTS

| | | | | |
|---|---|---|---|---|
| 430,703 | A | 6/1890 | Spahn et al. | 297/452.13 X |
| 1,273,521 | A | 7/1918 | Morris | 297/452.13 X |
| 3,107,944 | A | 10/1963 | Baermann | 297/452.56 |
| 3,120,407 | A | 2/1964 | Propst | 297/452.13 X |
| 3,224,017 | A | 12/1965 | Zerbee | 297/452.64 |
| 4,318,556 | A | 3/1982 | Rowland | 297/452.64 X |
| 5,405,179 | A | 4/1995 | Jih | 297/452.63 X |
| 6,059,368 | A | 5/2000 | Stumpf et al. | 297/452.64 X |
| 6,082,824 | A | 7/2000 | Chow | 297/452.56 |
| 6,264,279 | B1 | 7/2001 | Chow | 297/452.56 |
| 6,588,842 | B2 | 7/2003 | Stumpf et al. | 297/452.64 X |
| 6,755,477 | B2 | 6/2004 | Chow | 297/452.56 |
| 6,786,544 | B1 | 9/2004 | Muraishi | 297/452.56 X |
| 6,957,861 | B1 | 10/2005 | Chou et al. | 297/452.64 X |
| 6,983,997 | B2 | 1/2006 | Wilkerson et al. | 297/452.56 |
| 7,066,550 | B1 | 6/2006 | Su | 297/452.56 X |
| 7,237,847 | B2 | 7/2007 | Hancock et al. | 297/452.56 |
| 7,267,408 | B2 | 9/2007 | Xiang | 297/452.64 X |
| 7,270,378 | B2 | 9/2007 | Wilkerson et al. | 297/452.56 |
| 7,434,888 | B2 * | 10/2008 | Lin | 297/452.56 |
| 2002/0060493 | A1 | 5/2002 | Nishino et al. | 297/452.56 |
| 2007/0102987 | A1 | 5/2007 | Chen | 297/452.56 |

OTHER PUBLICATIONS

Taiwan Utility Model Patent No. M 288142, Mar. 1, 2006, 6 pages.

* cited by examiner

*Primary Examiner*—Rodney B White
(74) *Attorney, Agent, or Firm*—Alan Kamrath; Kamrath & Associates PA

(57) ABSTRACT

A seat includes a tray, a net mounted on the tray and a supporting device provided between the tray and the net. Thus, when a user sits on the seat, the net takes a proportion of the user's weight while the supporting device takes another proportion of the user's weight.

16 Claims, 9 Drawing Sheets

CHAIR HAVING ADJUSTABLE WEIGHT PROPORTION ACCEPTING ELEMENTS

CROSS REFERENCE

The present application is a continuation-in-part application of U.S. patent application Ser. No. 11/564,386, filed on Nov. 29, 2006 now U.S. Pat. No. 7,434,888.

BACKGROUND OF THE INVENTION

1. Field of the Invention

The present invention relates to a chair and, more particularly, to a seat for use in a chair.

2. Description of the Related Art

According to Taiwanese Patent M288142, a chair 1 includes a plurality of legs 2, a post mounted on the legs 2, a seat 3 mounted on the post and a backrest mounted on the seat 3. The seat 3 includes a plate 31 mounted on the post and a net 32 mounted on the plate 31. The plate 31 is rigid for supporting the net 32. The net 32 is elastic for flexibly supporting a user's hips. A space 33 is defined between the net 32 and the plate 31. Air is allowed to travel into and from the space 33. Thus, heat does not accumulate below the user's hips. However, due to fatigue after some time of use, the net 32 inevitably loses the elasticity and the ability to support the user's hips and keep the space 33.

The present invention is therefore intended to obviate or at least alleviate the problems encountered in the prior art.

SUMMARY OF THE INVENTION

According to the present invention, a seat includes a tray, a net mounted on the tray and a supporting device provided between the tray and the net. Thus, when a user sits on the seat, the net takes a proportion of the user's weight while the supporting device takes another proportion of the user's weight.

The primary advantage of the seat according to the present invention is that the net lasts long, since it takes only proportion of the user's weight while the supporting device takes another proportion of the user's weight.

Other advantages and features of the present invention will become apparent from the following description referring to the drawings.

BRIEF DESCRIPTION OF THE DRAWINGS

The present invention will be described through detailed illustration of the preferred embodiment referring to the drawings.

DETAILED DESCRIPTION OF THE PREFERRED EMBODIMENTS

Figure 1:
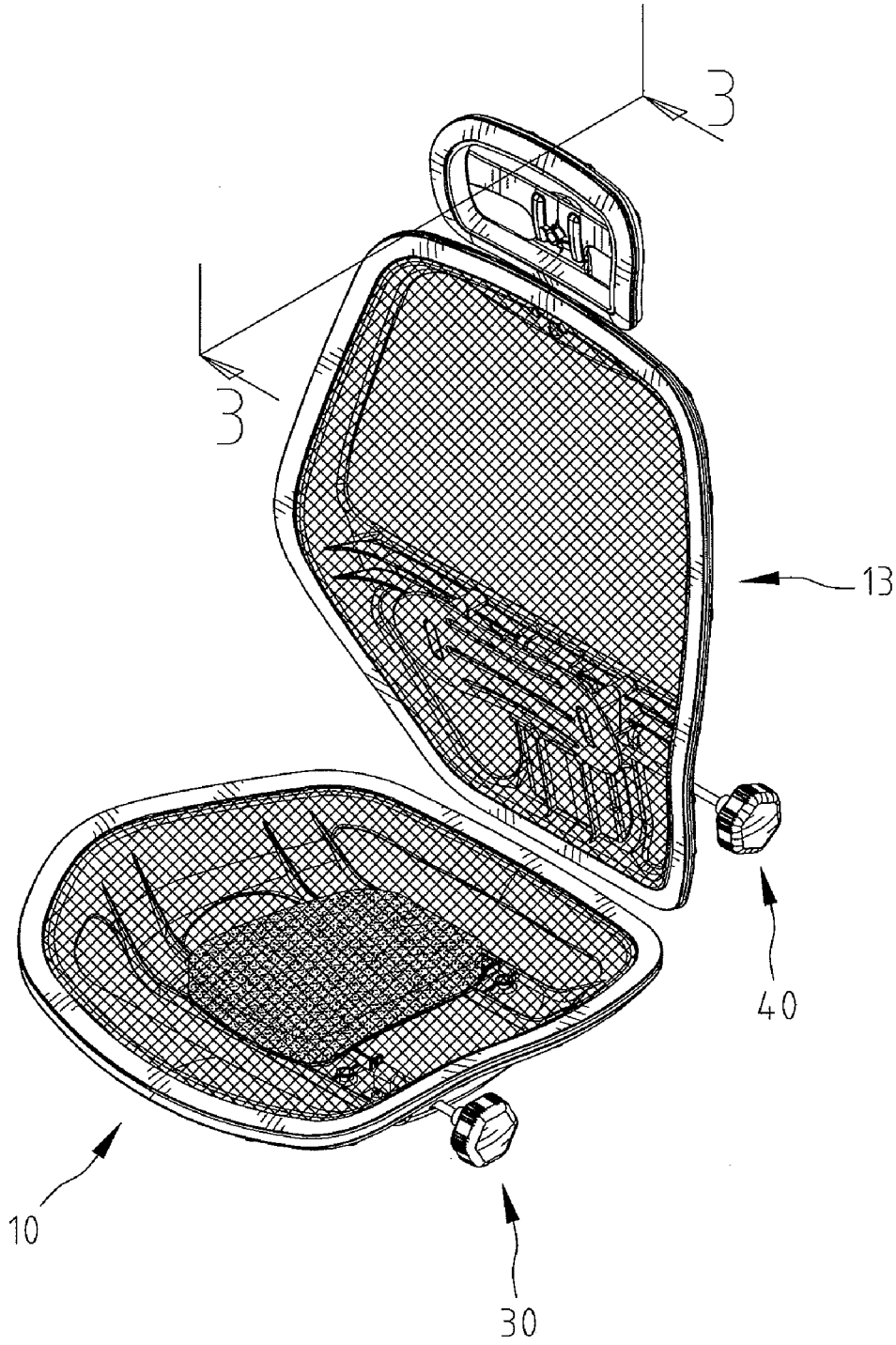
FIG. 1 is a perspective view of a seat and a backrest for use in a chair according to a first embodiment of the present invention.
Figure 2:
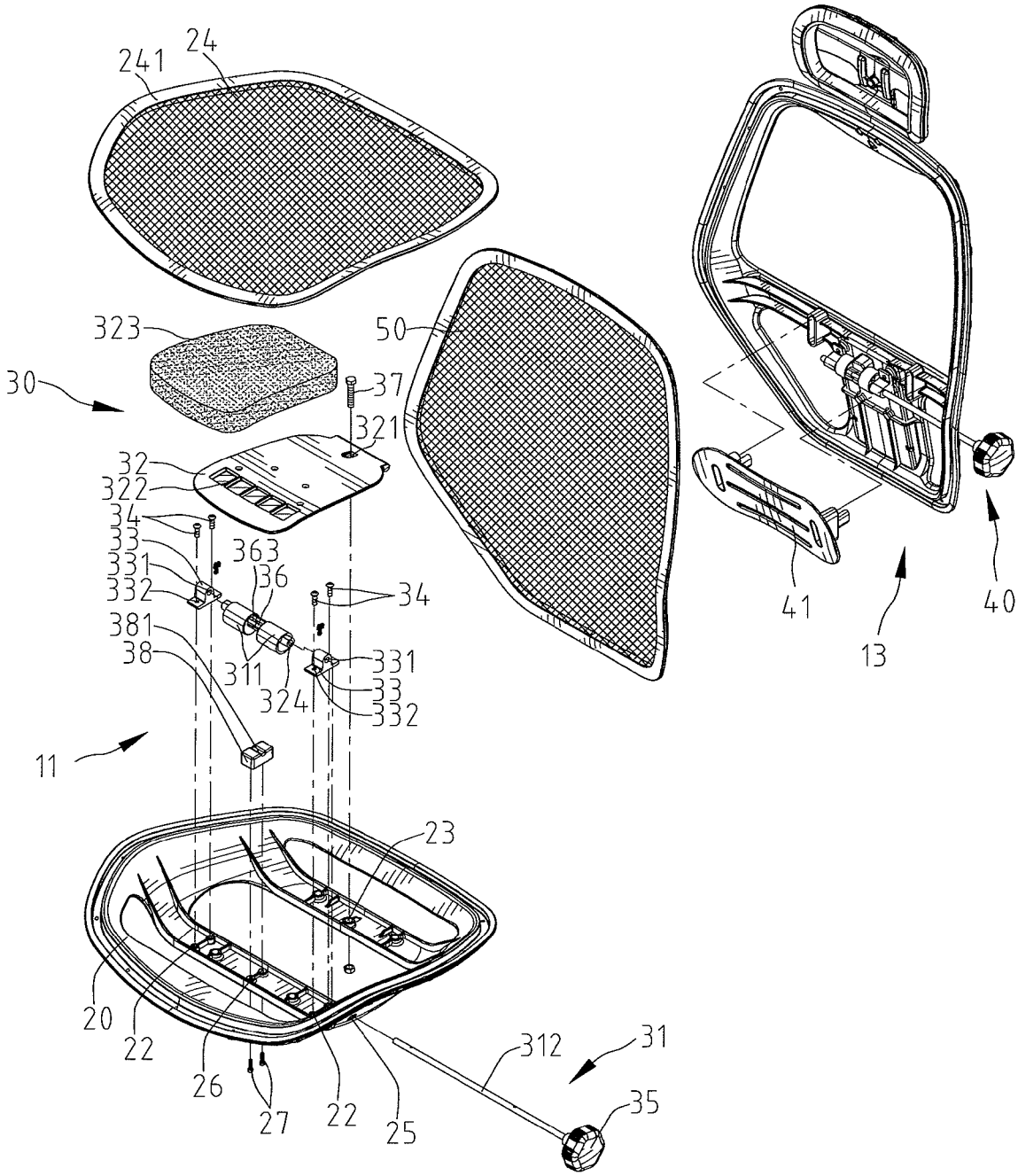
FIG. 2 is an exploded perspective view of the seat and the backrest shown in FIG. 1.

Referring to FIGS. 1 through 8, a chair in accordance with a first embodiment of the present invention includes a seat 11 and a backrest 13 connected to the seat 11.

The seat 11 includes a bowl shaped tray 20. A net 24 is connected to the tray 20 for taking a proportion of the user's weight. The net 24 includes a periphery connected to the rim of the tray 20 and extends over the interior of the tray 20. The net 24 may be replaced with a web or a sheet. A frame 241 is connected at the periphery of the net 24 for supporting the net 24. A supporting device 30 is provided between the net 24 and the tray 20 and is located within the interior of the tray 20 for taking another proportion of the user's weight.

The supporting device 30 includes a first bearing 33 and a second bearing 33 connected to the tray 20 by a plurality of fasteners 34. Specifically, the plurality of fasteners 34 are driven into a plurality of apertures 332 defined by the bearings 33 respectively, and through a plurality of screw holes 22 near a front edge of the tray 20 respectively. Further, a plate 32 is utilized for contact with the net 24 and includes an aperture 321 near a rear edge thereof and a plurality of ribs 322 on the bottom near a front edge thereof. The plate 32 is connected to the tray 20 by a threaded bolt 37. Preferably, the threaded bolt 37 is driven into a screw hole 23 near a rear edge of the tray 20 through the aperture 321 defined by the plate 32. Further, an adjusting element 31 is utilized for retaining the plate 32 at one of various positions spaced from the tray 20 to vary the proportion of the user's weight taken by the net 24.

The adjusting element 31 includes two cams 311 located beneath the plate 32 for moving the plate 32 between an upper position and a lower position. A positioning element 36 is disposed between the cams 312. Preferably, the cams 311 may be integrally formed with the positioning element 36. Further, a block 38 is interacted with the positioning element 36 for retaining the adjusting element 31 in a desired one of several positions. The block 38 is mounted in the interior of the tray 20. Preferably, a plurality of fasteners 27 are driven into the block 38 through a plurality of fastener holes 26 defined by the tray 20 respectively. The positioning element 36 includes a plurality of spokes 363 extending radially from a center thereof and the block 38 includes an indentation 381 for selectively receiving one of the plurality of spokes 363 as a desired position is set. Moreover, the spokes 363 of the positioning element 36 has a radius smaller than a radius of the associated cam 31, so that the positioning element 36 would not interfere with the plate 32. Further, an axle 312 is inserted through an aperture 25 near the rim of the tray 20 and rotatably connected to the bearings 33, the cams 312 and the positioning element 36. Specifically, each of the bearings 33 includes a tunnel 331 inserted by the axle 312; the cam 311 and the positioning element 36 include a through hole 324 extending longitudinally therein inserted by the axle 312. Additionally, the axle 312 has a center corresponding to a center of the through hole 324 defined in the positioning element 36, whereas the center of the axle 312 is eccentric to a center of the associated cams 311. Thus, each of the cams 311 includes a diameter comprised of a smaller radius and a larger radius in relation to the center of the axle 312. Further, a knob 35 is connected to the axle 312, and user can operate the knob 35 to rotate the axle 312. Additionally, a pad 323 which is made of soft material is mounted on the top of the plate 32 such that the pad 323 is intermediate the plate 32 and the net 24 for contact with the net 24 when the user sits on the seat 11.

The chair also includes another supporting device 40 connected to the backrest 13 for taking a proportion of the user's weight. Likewise, the supporting device 40 includes an axle 401, a positioning element 402 having a plurality of spokes 4021, a cam 403, a block 60 having an indentation 601 and a plate 41 for contact with a net 50, and the plate 41 is adapted to move between upper and lower positions. Further, the supporting device 40 may also include a pad (not shown).

Figure 3:
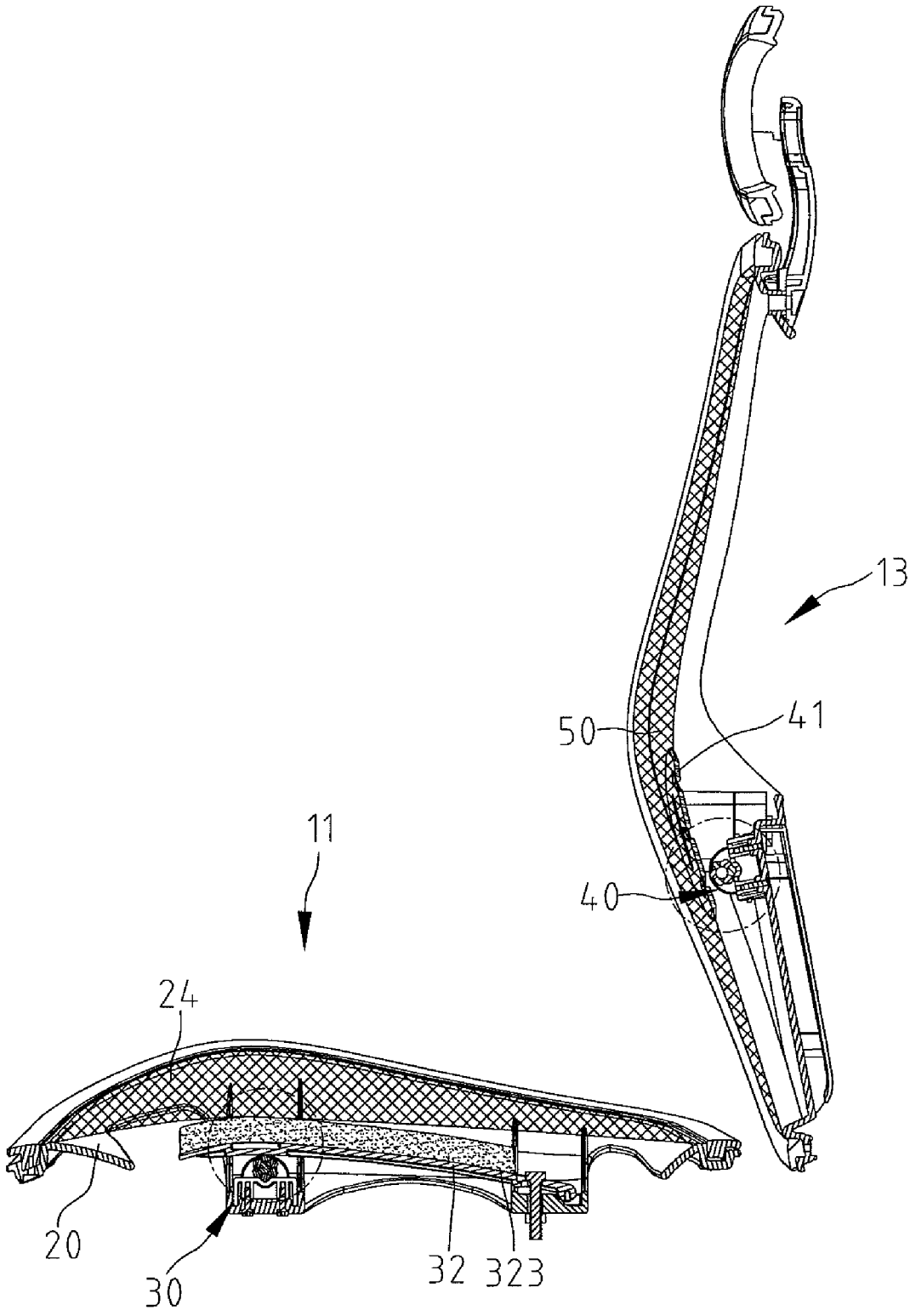
FIG. 3 is a cross-sectional view of the seat and the backrest taken along line 3-3 of in FIG. 1.
Figure 4:
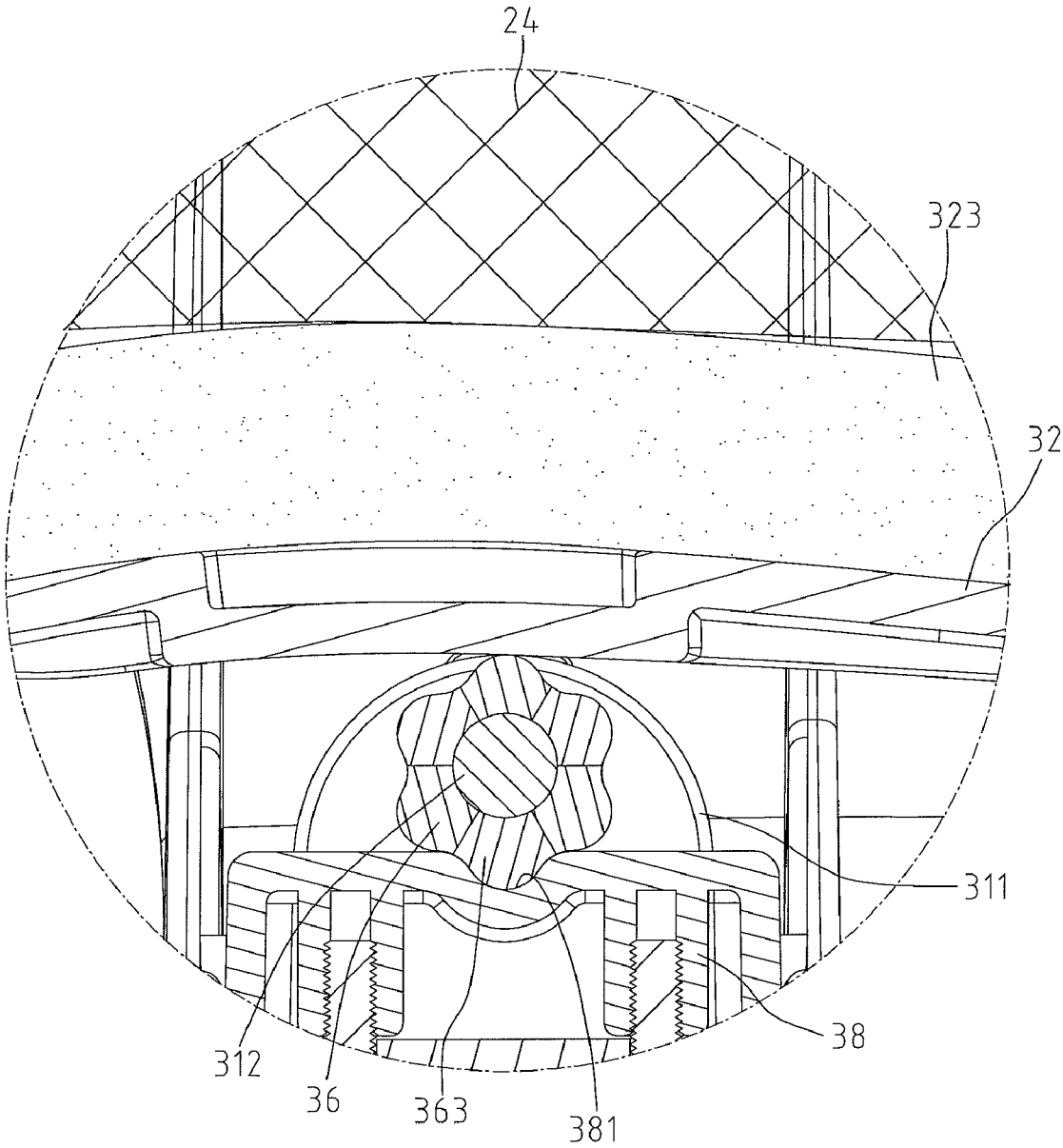
FIG. 4 is an enlarged partial view of the seat shown in FIG. 3.
Figure 5:
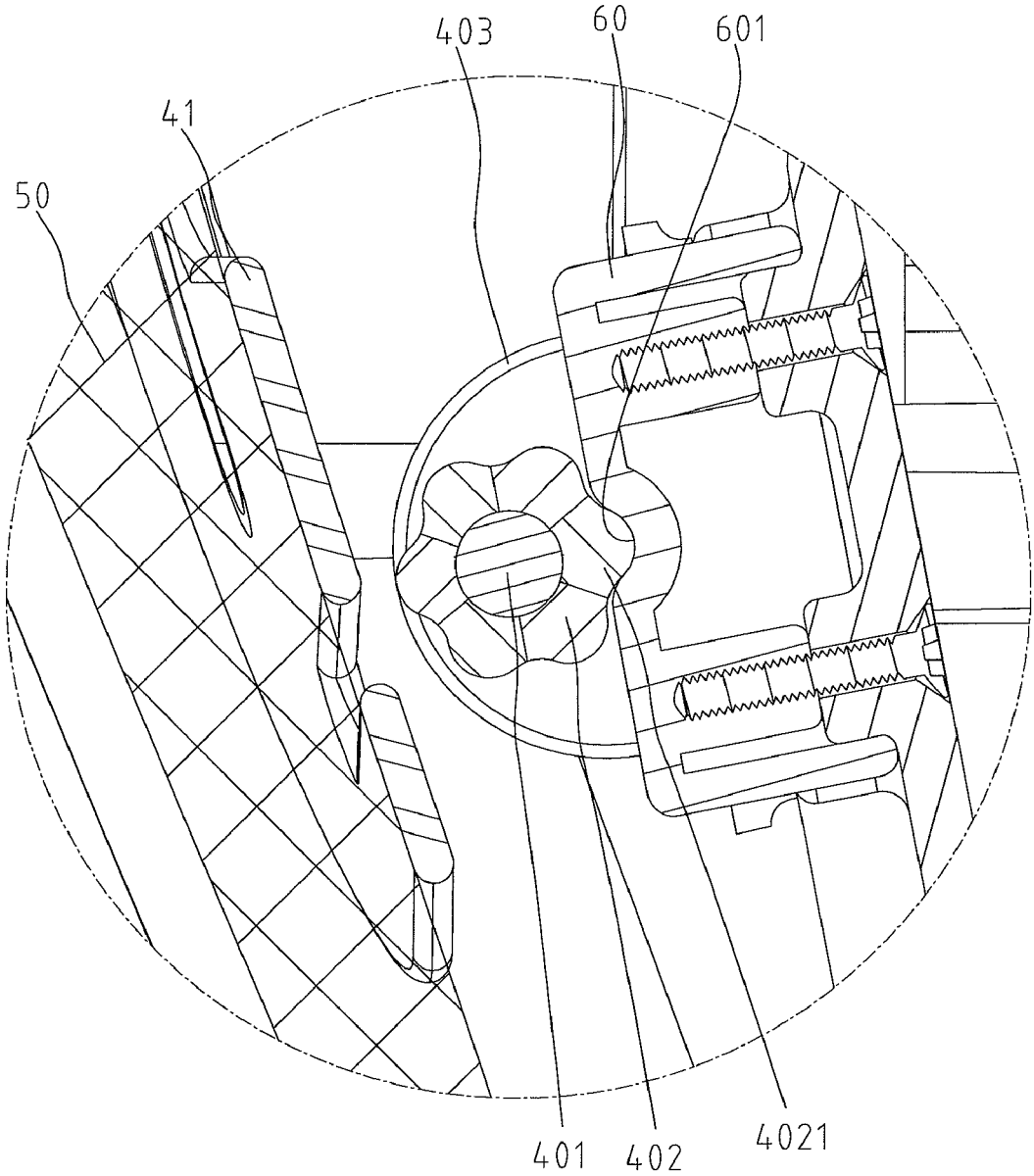
FIG. 5 is an enlarged partial view of the backrest shown in FIG. 3.
Figure 6:
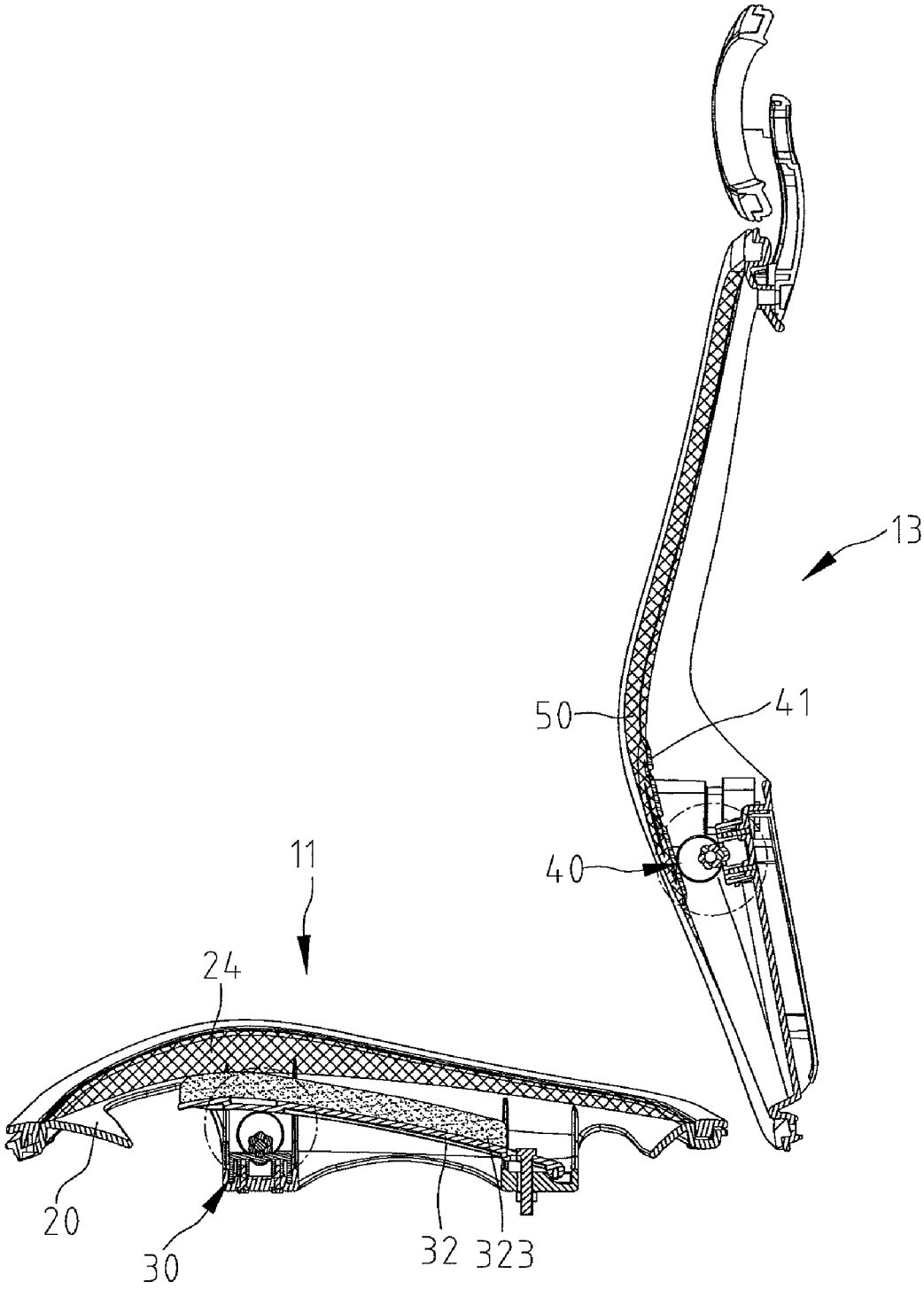
FIG. 6 is another cross-sectional view of the seat and the backrest shown in FIG. 1.

Referring specifically to FIGS. 3 through 5, when the pad 323 and the plate 32 in the seat 11 is in the lower position, the center of the axle 312 and the periphery of the associated cam 311 which is abutted by the plate 32 define a distance substantially equaling to the smaller radius defined by the cam 311. Thus, when the user sits on the seat 11, the pad 323 and the plate 32 will take a smallest proportion of the user's weight while the net 24 will take a largest proportion of the user's weight. When the plate 41 in the backrest 13 is in the lower position, the center of the axle 401 and the periphery of the cam 403 which is in proximity to the plate 41 define a distance substantially equaling to the smaller radius defined by the cam 403. Thus, when the user reclines on the backrest 13, the plate 41 will take a smallest proportion of the user's weight while the net 50 will take a largest proportion of the user's weight.

Figure 7:
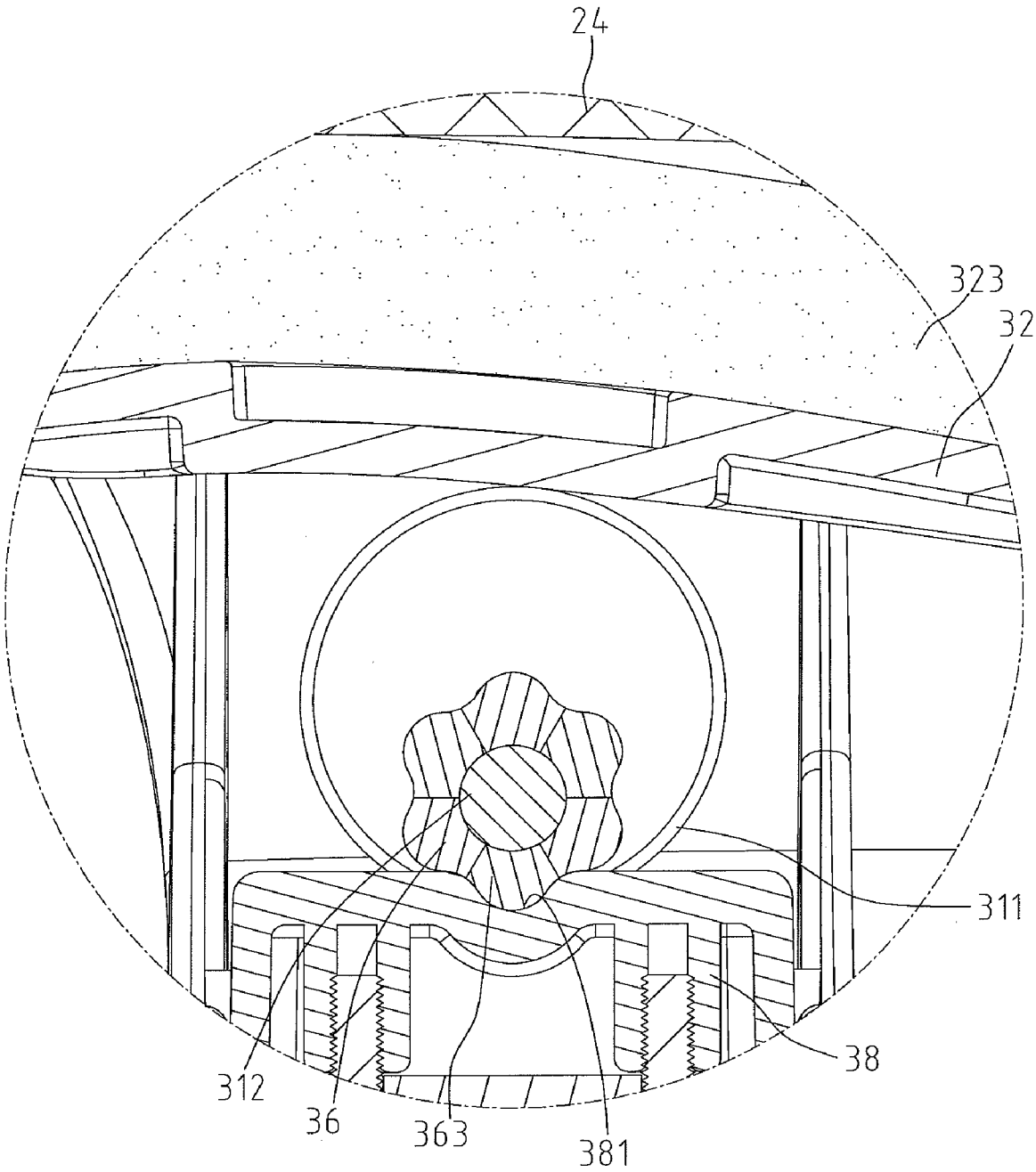
FIG. 7 is an enlarged partial view of the seat shown in FIG. 6.
Figure 8:
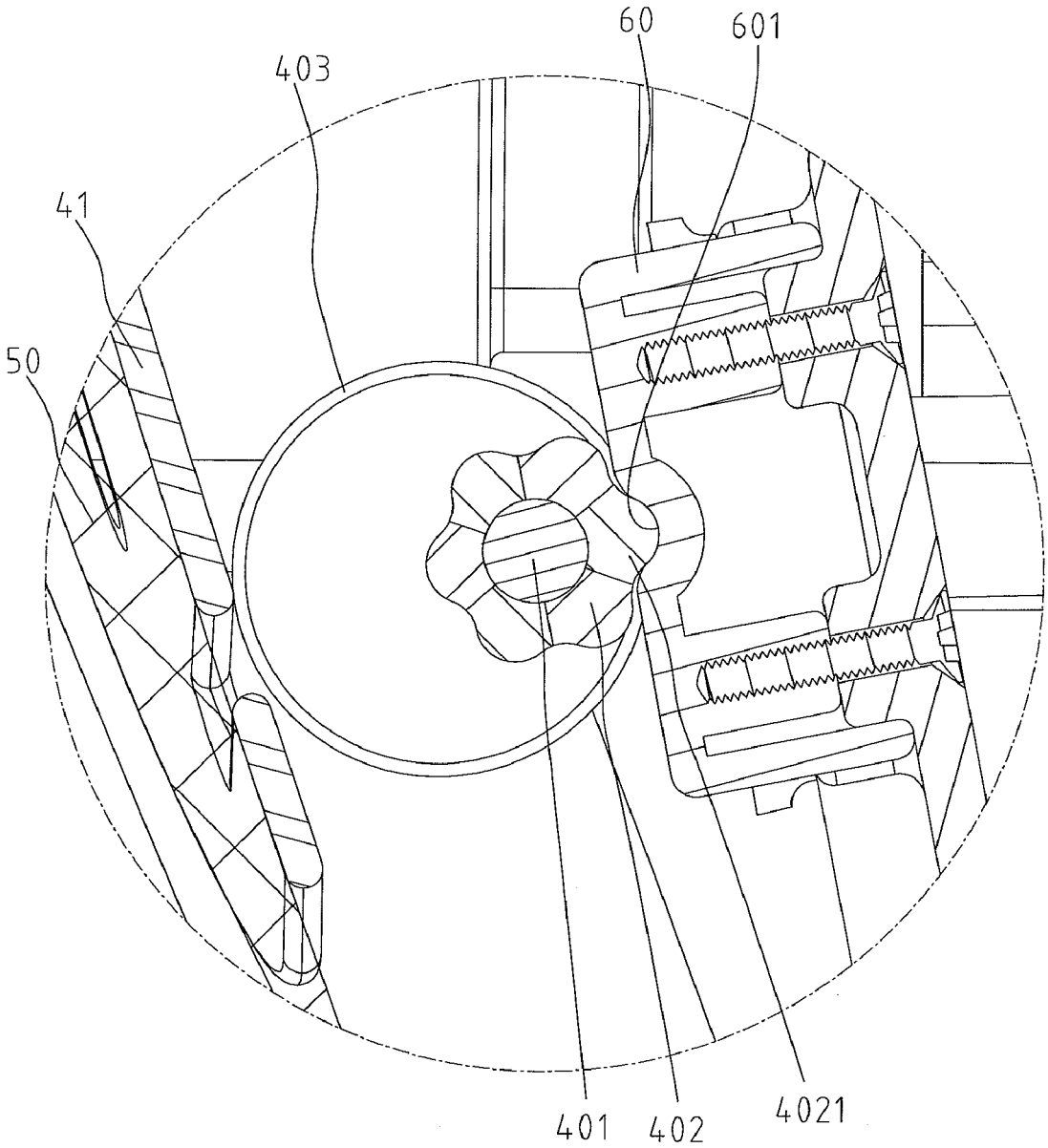
FIG. 8 is an enlarged partial view of the backrest shown in FIG. 6.

Referring specifically to FIGS. 7 through 8, when the pad 323 and the plate 322 in the seat 11 is in the upper position, the center of the axle 312 and the periphery of the associated cam 311 which is abutted by the plate 32 define a distance substantially equaling to the larger radius defined by the cam 311. Thus, when the user sits on the seat 11, the pad 323 and the plate 32 will take a largest proportion of the user's weight while the net 24 will take a smallest proportion of the user's weight. When the plate 41 in the backrest 13 is in the upper position, the center of the axle 401 and the periphery of the cam 403 which is abutted against the plate 41 define a distance substantially equaling to the larger radius defined by the cam 403. Thus, when a user reclines on the backrest 13, the plate 41 will take a largest portion of the user's weight while the net 50 will take a smallest proportion of the user's weight.

Figure 9:
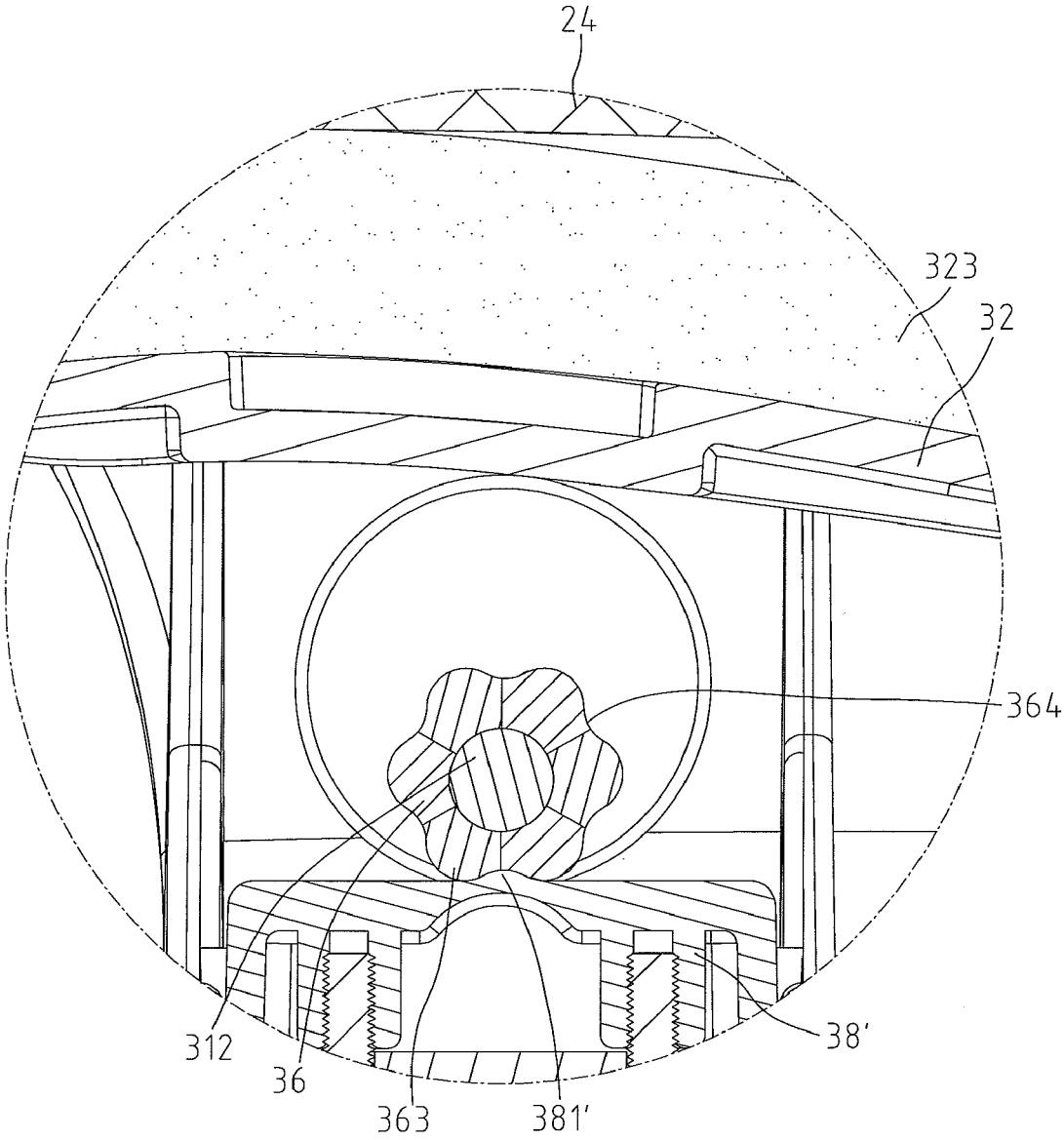
FIG. 9 is an alternative embodiment of the seat in accordance with the present invention.

FIG. 9 shows an alternative embodiment similar to the second embodiment except that the block 38' which replaces the block 38 includes a ridge 381' for selectively engaging a plurality of recesses 364 which alternating with the plurality of spokes 363. Likewise, structure of the block 38' may also apply to the block 60 installed in the backrest 13.

In light of the forgoing, the seat according to the present invention exhibits several advantages. Firstly, the net lasts long, since it takes only proportion of the user's weight while the supporting device takes another proportion of the user's weight.

Secondly, it enables the user to choose how he or she should be supported. Wishing to have a hard feel, the user disposes the pad and the plate in the upper position. Wishing to have a soft feel, the user disposes the pad and the plate in the lower position.

Thirdly, the pad and the plate can be retained in a desired one of several positions.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A seat comprising:

a tray, a net mounted on the tray; and a supporting device provided between the tray and the net so that when a user sits on the seat, the net takes a proportion of the user's weight while the supporting device takes another proportion of the user's weight, wherein the supporting device comprises a plate with a portion connected to the tray and another portion for contact with the net when the user sits on the seat; and an adjusting element for adjusting the height of the plate on the tray, wherein the adjusting element comprises an axle rotationally mounted on the tray, a cam and a positioning element connected to the axle and located beneath the plate, and a block mounted in the interior of the tray and interacted with the positioning element for retaining the adjusting element in a desired one of several positions.

2. The seat according to claim 1 wherein the adjusting element comprises a threaded bolt and the plate defines an aperture, and the tray defines a screw hole for receiving the threaded bolt inserted through the aperture of the plate, with the rotation of the adjusting element spacing the tray at the one of the various positions.

3. The seat according to claim 1 further comprising a pad mounted on the plate and intermediate the plate and the net for contact with the net when the user sits on the seat.

4. The seat according to claim 1 wherein the supporting device comprises two bearings for supporting the axle.

5. The seat according to claim 4 wherein each of the bearings defines a tunnel for receiving a portion of the axle.

6. The seat according to claim 4 wherein the supporting device comprises a plurality of fasteners, and each of the bearings defines a plurality of apertures, and the tray defines a plurality of screw holes for receiving the fasteners inserted through the aperture of the bearings.

7. The seat according to claim 1 wherein the tray defines an aperture, and the axle comprises a portion inserted through the aperture of the tray, and the supporting device comprises a knob connected to the portion of the axle.

8. The seat according to claim 1 wherein the plate comprises a plurality of ribs in contact with the cam.

9. The seat according to claim 1 wherein the supporting device comprises a block connected to the tray, and the positioning element comprises a plurality of spokes extended from a center thereof and engaged with the block.

10. The seat according to claim 9 wherein the block comprises an indentation selectively engaging with one of the plurality of spokes.

11. The seat according to claim 9 wherein the block comprises a ridge, and wherein the positioning element comprises a plurality of recesses which alternating with the plurality of spokes, and with the ridge selectively engaging with one of the plurality of recesses.

12. The seat according to claim 1 comprising a frame for supporting the net.

13. The seat according to claim 1 further comprising a backrest, a net mounted on the backrest and another supporting device provided between the backrest and the net so that when a user reclines on the seat, the net takes a proportion of the user's weight while the supporting device takes another proportion of the user's weight, and wherein the supporting device comprises a plate and an adjusting element for adjusting the height of the plate on the backrest, wherein the adjusting element comprises an axle rotationally mounted on the backrest and a cam and a positioning element formed on the axle and located beneath the plate.

14. The seat according to claim 13 wherein the supporting device mounted in the backrest comprises two bearings for supporting the axle.

15. The seat according to claim 13 wherein the supporting device mounted in the backrest comprises a block connected to the backrest, and the positioning element comprises a plurality of spokes extended from a center thereof and engaged with the block.

16. The seat according to claim 15 wherein the block comprises an indentation selectively engaging with one of the plurality of spokes.

* * * * *